United States Patent [19]

Johnson et al.

[11] 4,381,873

[45] May 3, 1983

[54] IN SITU ROASTING AND LEACHING OF SULFIDE MINERALS

[75] Inventors: Clyde V. Johnson, Lakewood, Colo.; Wilhelmus G. J. Huijnen, Gouda, Netherlands

[73] Assignee: Occidental Research Corp., Wheat Ridge, Colo.

[21] Appl. No.: 177,397

[22] Filed: Aug. 12, 1980

[51] Int. Cl.[3] ..... E21B 43/28; E21C 41/14

[52] U.S. Cl. ..... 299/5; 166/259; 75/7

[58] Field of Search ..... 299/4, 5; 166/257, 259; 75/7, 21, 23

[56] References Cited

U.S. PATENT DOCUMENTS

| | | | |
|---|---|---|---|
| 2,954,218 | 9/1960 | Dew | 299/4 |
| 3,815,957 | 6/1974 | Spedden | 299/5 |
| 3,822,916 | 7/1974 | Jacoby | 299/4 |
| 3,834,760 | 9/1974 | Spedden | 299/5 |
| 3,841,705 | 10/1974 | Girard | 299/4 |
| 3,881,774 | 5/1975 | Van Poolen | 299/4 |
| 3,951,458 | 4/1976 | Cathles | 299/5 |
| 4,135,918 | 1/1977 | Ettel | 75/7 |
| 4,168,217 | 9/1979 | Dalvi | 75/7 |

OTHER PUBLICATIONS

Marathon Technical Disclosure, "Sulfur Dioxide From In Situ Burning of Low Grade Sulfide Deposit", vol. VII, p. 4, 12/70.

*Primary Examiner*—William F. Pate, III

*Attorney, Agent, or Firm*—Christie, Parker & Hale

[57] ABSTRACT

There is provided a process for recovery of metal values from an ore body containing sulfide minerals. The ore body is fractured for increasing its permeability. The fractured ore body is then roasted in situ to increase the permeability and porosity of ore body to liquid leach solutions. The roasted sulfide minerals in the ore body are thereafter contacted with a leach solution to extract metal values therefrom and the extracted metal values are recovered.

15 Claims, 3 Drawing Figures

35
32
38
28
10
16
16
20
12
24
24
14
34
36
14
26
18
22
34
30
12
36
26
18
15

IN SITU ROASTING AND LEACHING OF SULFIDE MINERALS

BACKGROUND OF THE INVENTION

It has been found that various ore bodies, i.e., mineral deposits, cannot be economically mined using conventional mining methods. For example, a mineral deposit can be located at a sufficient depth or can contain such a low percentage of mineral values that the cost of using conventional mining methods is greater than the value of the minerals recovered.

One technique that has been used to recover mineral values from such deposits is in situ leaching. In an in situ leaching process, a liquid leach solution is generally provided to contact the minerals by downward percolation through the mineral deposit. The liquid leach solution extracts the minerals and provides a pregnant liquor which is pumped from the deposit to a recovery operation for recovery of mineral values.

One of the major problems encountered when using an in situ leaching technique is that generally the mineral deposit does not have the desired permeability for the leach solutions. For example, a deposit having a low permeability can result in a low rate of travel of leach solution through the deposit, thereby increasing the time and decreasing the rate at which mineral values are recovered. Also, when leaching values from a mineral deposit having a low or non-uniform permeability, the leach solution can bypass portions of the deposit, thereby reducing the amount of values extracted by the leach solution and resulting in a reduced yield from the process.

Attempts have been made to improve the process of leaching with liquid leaching solvents by increasing the permeability and porosity of mineral deposits.

For example, U.S. Pat. Nos. 3,822,916; 3,823,981; and 3,841,705 illustrate processes that use hydrofracturing or explosive techniques to increase the permeability and porosity of ore deposits prior to leaching the ore deposits with leach solutions. It has been found, however, that use of such fracturing and explosive techniques has not resulted in the desired permeability and porosity of ore deposits for efficient liquid leaching operations.

It is, therefore, desirable to provide a process which promotes increased permeability and porosity of an ore body for enhancing recovery of minerals when using liquid leach solutions.

SUMMARY OF THE INVENTION

This invention relates to a process for increasing the permeability of an ore body containing sulfide minerals. The ore body containing sulfide minerals is fractured for increasing the permeability of the ore body sufficiently to allow passage of gases therethrough. The fractured ore body is roasted in situ by igniting at least a portion of the sulfide minerals contained in the ore body. Combustion of sulfide minerals for heating the ore body is maintained by introducing an oxygen-supplying gas into the fractured ore body.

In one embodiment of the invention, the ore body contains iron-copper sulfide minerals. The ore body containing iron-copper sulfide minerals is fragmented to form a fragmented mass comprising iron-copper sulfide mineral particles. The fragmented mass comprising iron-copper sulfide mineral particles is roasted in situ to concentrate copper values in a center region of such a roasted iron-copper sulfide mineral particle. Additionally, an iron-rich oxide crust is formed which surrounds the center region of such a roasted iron-copper sulfide mineral particle. The iron-rich oxide crust is removed to expose the center region of such a mineral particle. Thereafter, copper values are leached from the roasted iron-copper sulfide mineral particles.

DRAWINGS

These and other features, aspects, and advantages of the present invention will become better understood with reference to the following description, appended claims, and accompanying drawings wherein:

DETAILED DESCRIPTION

Figure 1:
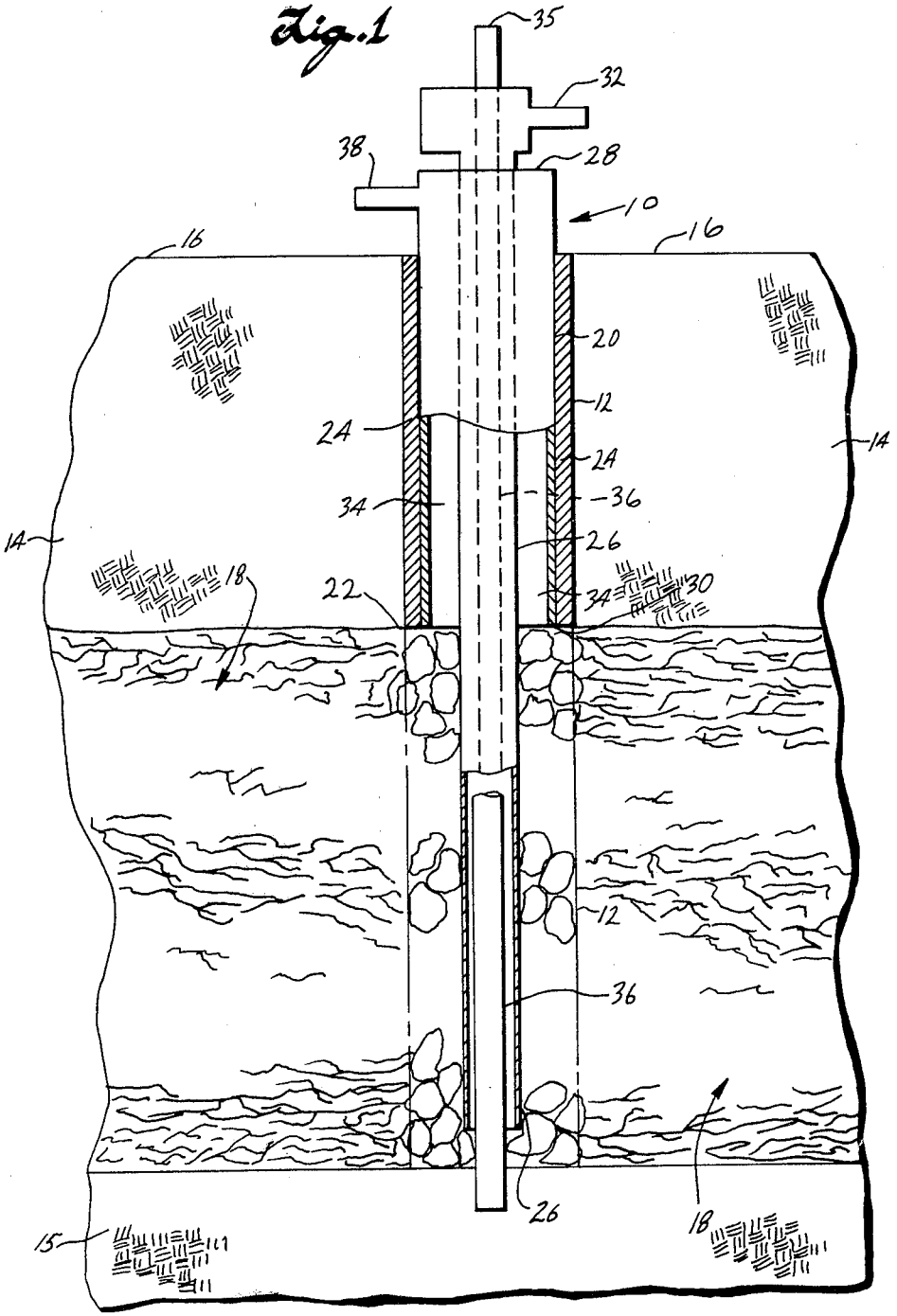
FIG. 1 is a semi-schematic, vertical, cross-sectional view of a sulfide mineral deposit at one stage of preparation in an exemplary embodiment of a roasting and leaching process according to this invention.

This invention relates to a process for increasing the permeability of an ore body containing sulfide minerals to liquid leach solutions. More particularly, this invention relates to a roasting and leaching process for recovery of metal values from an ore body comprising sulfide minerals.

The process comprises fracturing and/or fragmenting an ore body comprising sulfide minerals to form ore surfaces within the ore body. For example, when the ore body is fractured, ore surfaces are formed along the fractures or cracks. Additionally, fragmented particles comprising sulfide minerals can be formed, wherein an ore surface surrounds each particle. If desired, the entire ore body can be fragmented forming a fragmented permeable mass of sulfide mineral particles.

After the ore body is fractured and/or fragmented, it has sufficient permeability to allow gases to flow therethrough while it may not have sufficient permeability for sustaining a successful aqueous leaching operation. Therefore, after fracturing and/or fragmenting the ore body, the ore body is roasted in situ to increase its permeability to aqueous liquid leach solutions.

The term "roast" is used herein means to heat sulfide minerals in the presence of oxygen to convert sulfides to oxides.

The permeability of the ore body is increased in several ways during the roasting process. When roasted, the sulfide minerals liberate sulfur in the form of sulfur dioxide gas. The sulfur dioxide gas passes from the ore body, thereby reducing the amount of material, i.e., the amount of sulfur in the deposit. This results in an ore body with increased permeability. Additionally, during the roasting process, various metal sulfides are converted to oxides. Since the oxides formed are generally more dense than the sulfides that had originally been present, the permeability of the sulfide ore body is further increased.

In addition to enhancing or increasing the permeability of the fractured or fragmented ore body, various sulfide minerals which are difficult to dissolve in dilute acid solutions are transformed by roasting into minerals that are more readily soluble. For example, various metal sulfides which are fairly insoluble in dilute acid solutions can be converted into metal oxides which are more soluble.

After the roasting is completed, a liquid leach solution is introduced into the ore body. The liquid leach solution percolates through the ore body contacting and extracting mineral values therefrom, to form a pregnant liquid leach solution, i.e., a pregnant liquor.

The pregnant liquid leach solution is recovered and processed for recovery of desired metal values.

Practice of principles of this invention can be used with any sulfide ore body. For example, useful sulfide ore bodies can comprise copper and iron-containing sulfide minerals such as chalcopyrite ($CuFeS_2$) and bornite ($Cu_5FeS_4$), copper-containing sulfide minerals such as chalcocite ($Cu_2S$) and covelite (CuS), zinc-containing minerals such as spahalerite (ZnS), lead-containing sulfide minerals such as galena (PbS), iron-containing sulfide minerals such as pyrite ($FeS_2$), nickel-containing sulfide minerals, and combinations thereof. In addition, the ore body can contain various other minerals in the form of carbonates, silicates, and oxides and the like.

Although the exemplary embodiments are directed to recovery of copper values, if desired, various other metals such as gold, silver, platinum, uranium, lead, zinc, nickel, and the like which are contained in the ore body can also be recovered therefrom.

FIG. 1 is a semi-schematic, cross-sectional view of a sulfide mineral deposit, i.e., an ore body containing sulfide minerals being prepared for roasting and leaching in accordance with an exemplary embodiment of this invention.

In the exemplary embodiment illustrated in FIG. 1, a well 10 is prepared by drilling a borehole 12 from the ground surface 16 downwardly into a sulfide mineral deposit 18. The well 10 is shown out of proportion in the figures for clarity of illustration, i.e., the well is actually much smaller in relation to the size of the ore body than shown. The sulfide mineral deposit of this exemplary embodiment is shown bounded by overlying formation 14 above and underlying formation 15 below. Conventional drilling or other borehole forming techniques which are well known in the mining art can be used for forming the borehole 12.

The ore body, i.e., the sulfide mineral deposit, is thereafter fractured for forming cracks within the ore body for providing an ore body that is reasonably permeable to gases. Additionally, ore surfaces are formed along the cracks and around sulfide mineral particles which are fragmented, i.e., which are broken completely free from the mass of the ore body.

FIG. 1 is shown at a time after the ore body is fractured and, to provide for clarity of illustration, the borehole is shown by solid lines 12 above the ore body 18 and by phantom lines 12 in the ore body.

The ore body can be fractured using hydrofracturing techniques or the like, but it is preferred that it be fractured by detonation of at least one explosive charge.

Additional details of hydrofracturing techniques can be found, for example, in U.S. Pat. Nos. 3,815,957 and 3,834,760 to Spedden et al., which are incorporated herein by this reference.

In the exemplary embodiment, explosive is placed into the borehole to form an explosive charge in the ore body and the borehole is stemmed with inert material using conventional techniques. If desired, to enhance the fracturing of the ore body and/or to enhance the recovery of metal values therefrom, more than one well can be formed in the deposit. When more than one well is formed, each well can be substantially similarly prepared so that, for purposes of exposition herein, the preparation of a single well is described.

The explosive charge that is formed in the borehole 12 is detonated to fracture the ore body 18, forming ore surfaces along the fractures. Ore surfaces also surround any fragmented particles that are expanded from the ore body into the borehole 12.

If desired, the entire ore body can be fragmented by detonation of explosive. For example, if, after an initial fracturing and fragmentation, additional fragmentation is desired, a portion of the fragmented sulfide mineral particles can be extracted from the borehole pneumatically or hydraulically and additional explosive can be placed into the borehole and detonated. The material removed provides void space for further fragmentation.

It is desired that the fracturing and/or fragmentation be sufficient to provide an ore body which is reasonably permeable to gases as described above.

Following the detonation of explosive to provide the fractured ore body, preparation of the well is completed.

For example, following detonation of the explosive charge, a casing 20 is inserted into the borehole 12. The casing 20 extends from above the ground surface 16 to about the upper surface 22 of the fractured ore body. The casing 20 is fixed in place by injecting cement grout or the like into an annular space 24 circumferentially surrounding the casing between the casing and the borehole 12. This prevents fluids from escaping through the annular space 24 when the well is in use.

A fluid transport pipe 26, which has a smaller outside diameter than the inside diameter of the casing 20, is lowered downwardly through the casing and said transport pipe extends from above the casing top 28 to below the casing bottom 30. It is preferred that the fluid transport pipe 26 extend down to about the bottom of the borehole 12. The pipe 26 extends into the borehole through the fragmented mass of particles which have been expanded from the ore body and which fill or partly fill the borehole. Additional information relating to a method for extending a pipe downwardly through a fragmented mass of particles is disclosed in U.S. Pat. No. 3,620,301 to Nichols which is incorporated herein by this reference.

It is preferred that the fluid transport pipe extend to about the bottom of the borehole so that the ore body can be ignited in a lower region. This enhances the heating of the entire ore body.

After the ore body is fractured and preparation of the well 10 is completed, the fractured ore body is roasted in situ.

The roasting process comprises heating sulfide minerals in the ore body to the desired roasting temperature of from about 250° C. to about 1500° C. to convert sulfide to oxides. The temperature of sulfide minerals is desired to be maintained above the lower limit of about 250° C. to enhance the economics of the process by providing an economical rate of reaction. Also, it is desirable to maintain the temperature of sulfide minerals below about 1500° C. to avoid fusion in the deposit which can reduce the permeability of the deposit to gases and leach solutions.

It has been determined that combustion of sulfide minerals can provide sufficient energy in the form of heat of reaction to sustain a roasting process without a continuous external supply of heat to the system. Therefore, unless very large amounts of inert materials are present in the sulfide mineral deposit, i.e., in the ore body, combustion and roasting of the sulfide minerals is self-sustaining.

It is preferred that sulfide minerals are heated to at least their ignition temperature and that combustion of the sulfide minerals is maintained by introducing an oxygen-supplying gas into the fragmented or fractured ore body 18. By this technique, the combustion of the sulfide minerals can provide sufficient heat to complete the roasting process.

The sulfide minerals in such an ore body can be ignited by use of electric heaters, hot air, gas burners, or by other sources of thermal energy.

In an exemplary embodiment, the sulfide minerals are roasted in situ by first igniting sulfide minerals adjacent the bottom of the fluid transport pipe 26. The ignition of the sulfide minerals is accomplished by introducing fuel and an oxygen-supplying gas such as air or oxygen-enriched air or the like into the inlet 32 of the fluid transport pipe 26. The fuel and oxygen are supplied in the desired proportion to form a combustible mixture and the mixture is ignited. The ignited mixture contacts sulfide minerals adjacent the bottom of the fluid transport pipe 26, heating the sulfide minerals to above the temperature at which combustion of the sulfide minerals is self-sustaining, i.e., to above the ignition temperature of the minerals.

In one example of practice of principles of this invention, copper values are recovered from the sulfide mineral, chalcopyrite. It has been found that in order to ignite chalcopyrite with air, the chalcopyrite is required to be heated to between about 650° C. and about 820° C.

Once a portion of the sulfide minerals is ignited, it is desirable to stop the introduction of fuel while continuing the introduction of the oxygen-supplying gas to support the combustion and roasting of the sulfide minerals. Stopping the introduction of fuel while continuing to roast the sulfide minerals improves the economics of the process.

Sulfide minerals can be roasted, i.e., heated, to convert sulfides to oxides by maintaining the temperature of the minerals from about 250° C. to about 1500° C. as described hereinabove. Different temperature ranges are more or less desirable depending on the composition of the sulfide mineral deposit used in accordance with this invention. For example, it has been found that to maintain combustion of chalcopyrite, the temperature of the chalcopyrite should be maintained above about 650° C. and, preferably, during the roasting process, chalcopyrite is maintained at a temperature above about 700° C. Additionally, the chalcopyrite temperature is desirably maintained at less than about 1100° C. to reduce the possibility of fusing materials in the deposit.

During the roasting process, at least a portion of the sulfur comprising the sulfide minerals combines with the oxygen being introduced by the oxygen-supplying gas to form sulfur dioxide gas ($SO_2$). Combustion gases from the combustion of the sulfide minerals including the $SO_2$ gas pass through the fractured or fragmented ore body, heating the sulfide minerals to the desired temperature for roasting.

As the roasting process continues, sulfur is liberated from the sulfide minerals. The liberation of sulfur is believed to substantially uniformly increase the permeability of the ore body.

Referring once again to FIG. 1, the combustion gases including $SO_2$ pass out of the fractured ore body and upwardly through an annular space 34 between the inner surface of the casing 20 and the outer surface of the fluid transport pipe 26 and thence pass through the outlet pipe 38. The sulfur dioxide evolved during the roasting process can be recovered and cleaned to meet market requirements for liquid $SO_2$ and/or can be converted to sulfuric acid to enhance the economics of the process. The sulfuric acid produced by the process, for example, can be used to form the leach solution which is used to recover metal values as is described below.

If desired, a water level control pipe 36 having a smaller outside diameter than the inside diameter of the fluid transport pipe 26 can be lowered downwardly through the fluid transport pipe. A water level control pipe 36 can extend downwardly into the formation below the ore body 18 and upwardly out through the inlet 32 of the fluid transport pipe. The water level control pipe can be used to keep the water table below the sulfide mineral deposit. If water is present, for example, it can be pumped out of the well by lowering a submersible pump downwardly into the bottom of the water level control pipe and pumping the water to the surface through the outlet 35. During roasting, the water level control pipe 36 is heated and steam can escape to the surface through the control pipe, thereby enhancing maintenance of the water table below the fragmented mass of mineral particles.

Alternatively, if desired, a water level control pipe can be lowered within the casing 20, but outside of the fluid transport pipe 26. That is, the water level control pipe can be lowered adjacent to and through the annulus 34. The water level control pipe can extend from the top of the casing downwardly into the unfragmented formation underlying the sulfide mineral deposit. Water can be pumped from the water table upwardly through such a pipe to maintain the water table below the level of the sulfide mineral deposit.

It can be desirable to form more than one well in a sulfide mineral deposit to extract values therefrom, depending on the size of the mineral deposit and other like factors. When more than one well is provided, each well can be prepared in a similar manner and the process of using each well can be similar. For example, each well can be prepared and used as described hereinabove for the preparation and use of the well 10. The use of more than one well can increase the volume of sulfide minerals fragmented and processed during the operation.

When more than one well is provided, one or more of the wells can be used as an inlet well and one or more wells can be used as an outlet well. For example, fuel and an oxygen-supplying gas can be provided through one or more inlet wells and the gases formed by combustion of sulfide minerals can traverse outwardly from such an inlet well through the fragmented or fractured ore body and thereafter flow upwardly through either one or more outlet wells.

Figure 2:
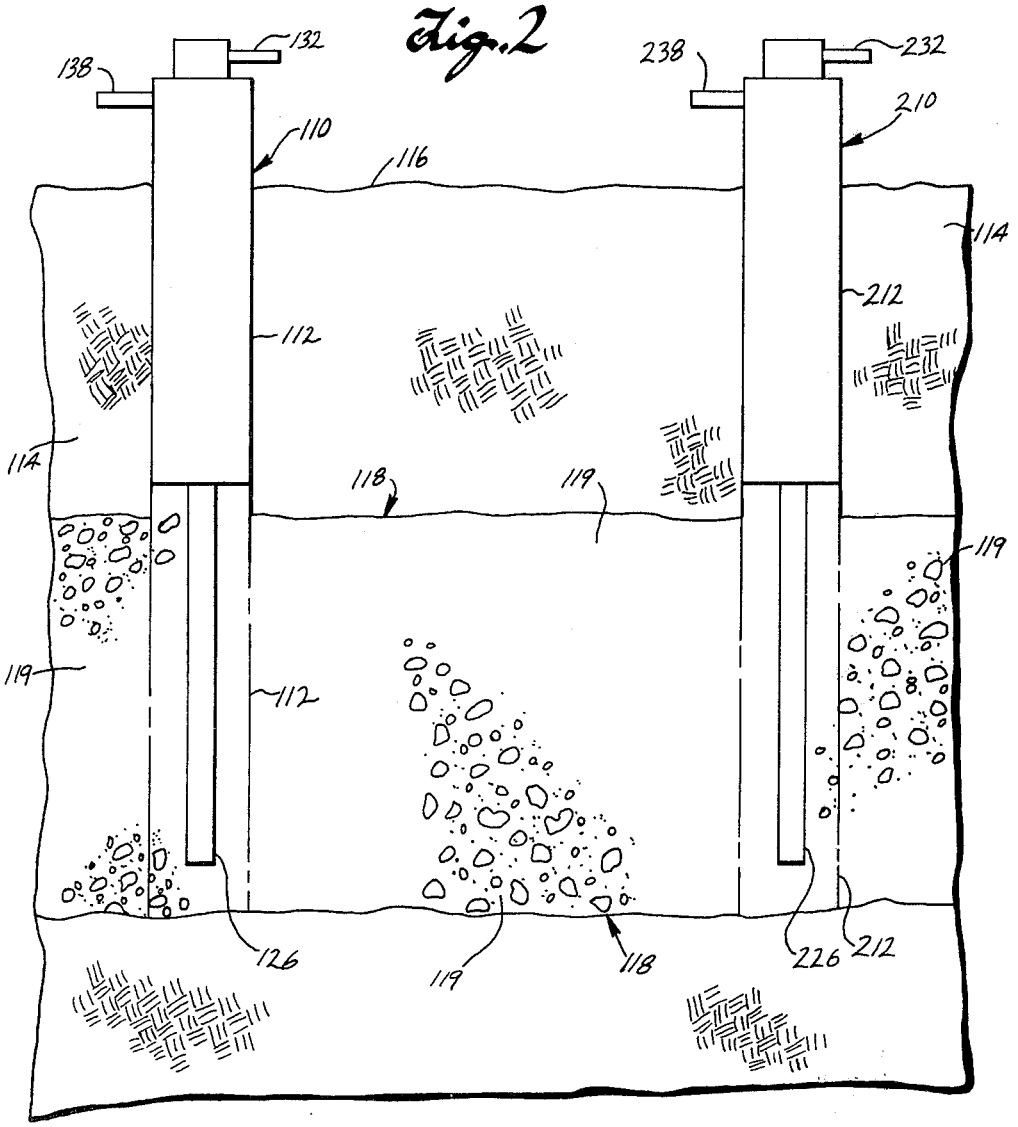
FIG. 2 is a semi-schematic, vertical, cross-sectional view of a sulfide mineral deposit at one stage in preparation in another exemplary embodiment of a roasting and leaching process according to this invention.

In an exemplary embodiment, a two well system used in practice of principles of this invention is shown in FIG. 2. The two well system includes a first well 110 and a second well 210. A first borehole 112 and a second borehole 212 are drilled through overlying formation 114 from the ground surface 116 and into a sulfide mineral deposit 118. Associated well equipment is shown in each borehole, for example, in the first well 110 there is shown a fluid transport pipe 126, casing outlet pipe 138, and fluid transport inlet pipe 132. The second well system 210 includes a fluid transport pipe 226, casing outlet pipe 238, and fluid transport pipe inlet 232.

In this exemplary embodiment, explosive is placed into the boreholes 112 and 212 to form explosive charges in the sulfide mineral deposit and each of the boreholes is stemmed using conventional techniques in preparation for fracturing and/or fragmenting the sulfide mineral deposit adjacent both the borehole 112 and the borehole 212.

In the exemplary embodiment, the explosive charges that are formed in the boreholes are detonated to fragment the sulfide mineral deposit 118 to form a fragmented mass of sulfide mineral particles 119. The fragmented mass of sulfide mineral particles surrounds each of the boreholes and, additionally, there is a common fragmented zone of sulfide mineral particles formed which extends between the borehole 112 and the borehole 212. The wells are thereafter prepared in a similar manner to the preparation of the well 10 described hereinabove.

The fragmented ore body adjacent the boreholes 112 and 212 and the common fragmented zone of sulfide mineral particles between the boreholes can be roasted by a procedure similar to the procedure described hereinabove for use with the single well 10. For example, the formation adjacent the borehole 112 can be roasted by passing an oxygen-supplying gas and fuel downwardly through the fluid transport pipe 126 and igniting the fuel and oxygen-supplying gas mixture. The combustion of the fuel heats the sulfide mineral deposit adjacent the fluid transport pipe 126, thereby raising the temperature of sulfide mineral particles to above the temperature at which combustion of the sulfide mineral particles is self-sustaining. The supply of fuel can thereafter be discontinued while continuing to supply the oxygen-supplying gas. Combustion products from the roasting process are recovered as they pass outwardly through the casing outlet 138. Roasting of sulfide mineral particles can be simultaneously accomplished using substantially identical procedures for the well 110 and the well 210, if desired.

Alternatively, one of the wells can be used as an inlet well and the other well can be used as an outlet well. For example, the well 110 can be used as an inlet well wherein a mixture of fuel and an oxygen-supplying gas is passed downwardly through the fluid transport pipe 126. The mixture is ignited which results in ignition of sulfide mineral particles adjacent the pipe 126, thereby roasting sulfide minerals. Products of combustion, including hot combustion gases, pass through the mass of sulfide mineral particles adjacent the well 110 and traverse outwardly from the well 110, passing through the common zone of fragmented sulfide mineral particles, and through the fragmented mass of particles adjacent the well 210. Thereafter, combustion products pass upwardly through the well 210 and out through the casing outlet 238. The sulfide mineral particles which are adjacent the well 110, those particles in the zone between the well 110 and the well 210, and the particles adjacent the well 210 are roasted as hot combustion gases pass through the fragmented permeable mass of sulfide mineral particles.

During roasting of sulfide minerals, a portion of the sulfur contained in the minerals is oxidized to form sulfur dioxide gas, as described above. In addition, during roasting of such sulfide minerals, other reactions take place which enhance the recovery of values from a sulfide mineral deposit. For example, when roasting an ore body which contains iron-copper sulfide minerals, the iron is selectively oxidized prior to any substantial oxidation of copper, forming an iron-rich oxide crust on the ore surfaces. Copper values are concentrated remote from the ore surface.

Figure 3:
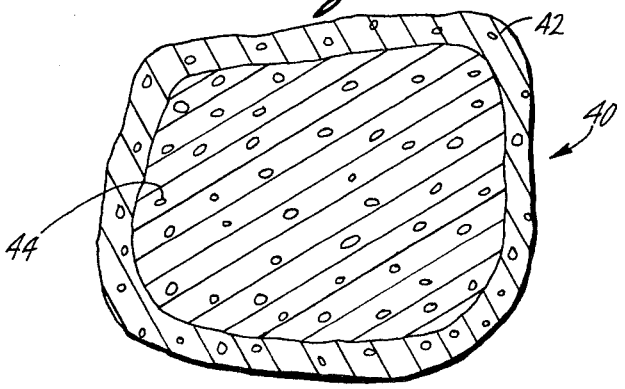
FIG. 3 is a semi-schematic, cross-sectional view of a mineral particle roasted in accordance with this invention.

Understanding of these reactions can be aided by referring to FIG. 3 which is a cross-sectional view of an iron-copper sulfide mineral particle 40 modified by roasting according to this invention. For convenience, the reactions will be explained in terms of roasting chalcopyrite, which is one of the iron-copper sulfide minerals useful in practice of principles of this invention, as described above.

In addition to the oxidation of sulfur during roasting, iron contained in the chalcopyrite particle 40 is selectively oxidized prior to any substantial oxidation of copper. The oxidized iron forms a crust 42 on the surface of such a mineral particle. The crust is enriched in iron values and surrounds a center region 44 of the chalcopyrite particle. It has been found that during the roasting process, iron values migrate from nearer the center region of a chalcopyrite particle towards an outer region, i.e., toward the surface, and copper values migrate toward the center region. The copper values are, therefore, concentrated remote from the ore surface.

The roasting process is continued until there is a substantial reduction in the amount of $SO_2$ gas evolved. For example, the composition of the combustion gas is monitored and when the amount of $SO_2$ in the combustion gas is reduced to less than about a few thousand ppm, the flow of oxygen-supplying gas into the fragmented mass of chalcopyrite particles is stopped, thereby terminating the roasting process. It is thought that this reduction in the generation of sulfur dioxide gas is in part caused by the formation of bornite in the center region of the chalcopyrite particle. Bornite has been determined to be more resistant to oxidation than chalcopyrite.

Such a roasted chalcopyrite particle 40, therefore, has a center region 44 which comprises copper values in the form of copper sulfide surrounded by an iron-rich oxide crust at its surface. The crust is considered iron-rich since it contains a higher proportion of iron relative to the copper than did the particle before roasting. Although it has been determined that the iron-rich oxide crust is generally fractured and porous, it is desirable to remove the crust to enhance the efficiency of leaching which can be used to recover copper values.

The iron-rich oxide crust is brittle and can be removed by subjecting the crust to shock or the like. For example, an explosive charge can be detonated in the vicinity of the roasted ore body to provide a shock wave to release the iron-rich oxide crust from the ore surfaces. By releasing the iron oxide crust, the copper values are exposed and are more readily accessible for contacting by leach solutions.

Thus, in an embodiment where the sulfide minerals comprise chalcopyrite, roasting is continued sufficiently to at least partly segregate copper values toward the center region of particles, i.e., away from the ore surfaces, and to form an iron-rich oxide outer region. The iron-rich outer region is in the form of a crust on the ore surface.

As previously described, the roasted ore body containing sulfide minerals has enhanced permeability because sulfur has been removed from the deposit in the form of sulfur dioxide gas during the roasting process. Because the sulfur is removed generally uniformly from the sulfide minerals in the ore body, the permeability of the ore body is substantially uniformly increased throughout. Additionally, during roasting, various metal sulfides are converted to oxides as described hereinabove and, because the oxides formed are generally more dense than the sulfides that had originally been present, the permeability of the ore body is further enhanced.

Roasting the ore body containing sulfide minerals, therefore, increases the permeability of the deposit and can enhance the yield of metal values extracted from the deposit by leaching.

For example, a leach solution can pass through the roasted ore body more rapidly than it can pass through a similar ore body that has not been roasted. It is also believed that the amount of such a roasted ore body which is bypassed by a leach solution is reduced when compared to the amount of bypassing in an ore body that has not been roasted. Additionally, oxides of metal values are generally more readily dissolved by leach solutions which further enhances the recovery of metal values from such a roasted ore body containing sulfide minerals.

Referring again to FIG. 1, a leach solution which is capable of extracting desired metal values from the roasted ore body is introduced into the roasted fractured and/or fragmented ore body. In an exemplary embodiment, the leach solution is introduced by pumping or the like through the outlet pipe 38. The leach solution passes downwardly through the annulus 34, thence into a top portion of the fractured ore body. The leach solution thereafter percolates downwardly and radially outwardly from the borehole through the ore body. The leach solution contacts sulfide minerals in the roasted ore body and extracts metal values therefrom while forming a pregnant liquid leach solution comprising extracted metal values.

It is preferred to introduce the leach solution into the roasted ore body while the ore body is still hot for enhancing the extraction of metal values. For example, it has been found that metal values are substantially more soluble and more readily extracted into a leach solution at 70° C. than when the leach solution is significantly cooler.

In an exemplary embodiment of the invention, as described hereinabove, the sulfide mineral deposit comprises chalcopyrite or the like and copper values are extracted therefrom. To extract copper values, a leach solution can be used which comprises a dilute mineral acid. It is preferred to use either hydrochloric acid or sulfuric acid solutions which can additionally comprise ferric sulfate if desired. Typical concentrations of such mineral acid solutions which can be used, for example, are about 20 grams of $H_2SO_4$ per liter of solution in combination, if desired, with about 2 grams of ferric sulfate per liter of solution.

Because of the presence of iron oxide in the roasted ore body containing chalcopyrite, ferric chloride (by NaCl addition) or ferric sulfate can be generated in situ. Ferric ions are strong oxidizing agents which facilitate the dissolution of copper sulfides in dilute mineral acid solutions such as dilute hydrochloric or sulfuric acid solutions.

In an exemplary embodiment, a dilute sulfuric acid solution contacts the exposed center region of roasted chalcopyrite particles contacting the copper values. The copper values are extracted into the leach solution, forming a pregnant liquid leach solution comprising copper values.

The pregnant sulfuric acid liquid leach solution can be removed from the leached fractured and/or fragmented ore body via the fluid inlet pipe 26 by use of conventional methods such as by pumping. For example, a submersible pump or the like can be used to pump the pregnant solution from the fragmented mass of roasted mineral particles.

When the pregnant liquid leach solution is substantially reduced in copper content, the sulfide mineral deposit can be further leached, if desired, with water by passage of water through the fluid annulus 34 and through the permeable roasted ore body, followed by pumping the water leach solution to the surface through the fluid inlet pipe 26.

When using a plurality of wells such as shown in the exemplary embodiment of FIG. 2, the liquid leach solution can be introduced into the roasted fractured and/or fragmented ore body 118 through a first well and recovered from a second well.

For example, the liquid leach solution can be introduced through the well 110. The solution thereafter flows radially outwardly from well 110 through the fragmented mass of roasted sulfide mineral particles which surrounds the well 110, thence through the common zone of roasted sulfide mineral particles, and through the fragmented permeable mass of roasted sulfide mineral particles adjacent the well 210. The liquid leach solution thereby extracts copper values from the roasted sulfide mineral particles, forming a pregnant liquid leach solution comprising copper values and the pregnant liquid leach solution is thereafter pumped from the well 210.

The pregnant copper containing leach solution and the water leach are then combined and subjected to a recovery process to recover the copper values. Exemplary of such recovery processes are liquid ion exchange processes, solvent extraction, precipitation, cementation, electrowinning, and the like.

While particular embodiments of the invention have been described for purposes of illustration, it will be understood that other changes and modifications of the invention will occur to those skilled in the art and the invention accordingly is not to be taken as limited except by the scope of the appended claims.

What is claimed is:

1. A process for increasing the permeability of an ore body containing iron-copper sulfide minerals comprising the steps of:

fracturing an ore body containing iron-copper sulfide minerals for forming ore surfaces within the ore body and for increasing the permeability of the ore body sufficiently to allow passage of gases therethrough;

roasting the fractured ore body in situ for forming a combustion gas comprising sulfur dioxide, the roasting being continued for a sufficient time for forming an iron-rich oxide crust on such ore surfaces and for concentrating copper values remote from such ore surfaces;

removing such a combustion gas from the ore body;

shocking the roasted ore body for releasing such an iron-rich oxide crust from the ore surfaces for exposing the concentrated copper values; and contacting the copper values with a leach solution comprising mineral acid for leaching said copper values from the ore body.

2. The process as claimed in claim 1 comprising the additional step of recovering sulfur dioxide from such a combustion gas and forming sulfuric acid from the recovered sulfur dioxide, wherein said leach solution comprises such formed sulfuric acid.

3. A process for the recovery of copper values from an ore body comprising iron-copper sulfide minerals, the process comprising the steps of:

(a) drilling at least one borehole into the ore body and placing at least one explosive charge into such a borehole;

(b) detonating such an explosive charge for fragmenting at least a portion of the ore body forming a fragmented mass comprising iron-copper sulfide mineral particles;

(c) inserting a casing into said borehole and cementing the casing in place;

(d) lowering a fluid transport pipe having a diameter less than the diameter of the casing downwardly through said casing, the fluid transport pipe extending below said casing and into a lower region of the fragmented mass of iron-copper sulfide mineral particles;

(e) roasting such a fragmented mass by:

(i) introducing a mixture of fuel and an oxygen-supplying gas downwardly through the fluid transport pipe and into the fragmented mass;

(ii) igniting the mixture of fuel and oxygen-supplying gas to heat at least a portion of the iron-copper sulfide minerals to above the ignition temperature of said iron-copper sulfide minerals;

(iii) discontinuing introduction of the fuel while continuing introduction of the oxygen-supplying gas for roasting the fragmented mass at a temperature between about 250° C. and about 1500° C. for forming a combustion gas comprising sulfur dioxide, for migrating iron values toward an outer region of each roasted iron-copper sulfide mineral particle, the iron values combining with oxygen to form an iron-rich oxide crust surrounding each roasted iron-copper sulfide mineral particle, and for migrating copper values toward a center region of each roasted iron-copper sulfide mineral particle;

(f) detonating an explosive charge in a region of the ore body to remove at least a portion of the iron-rich oxide crust surrounding each roasted iron-copper sulfide mineral particle for exposing the center region of each roasted iron-copper sulfide mineral particle;

(g) leaching copper values from the center region of each roasted iron-copper sulfide mineral particle by introducing a leach solution into the fragmented mass of roasted iron-copper sulfide mineral particles and contacting the center region of each roasted iron-copper sulfide mineral particle with the leach solution for forming a pregnant leach solution comprising copper values; and (h) recovering copper values from the pregnant leach solution.

4. The process as claimed in claim 3 wherein the ore body comprises chalcopyrite.

5. The process as claimed in claim 4 comprising the step of maintaining the temperature of iron-copper sulfide mineral particles which comprise the fragmented mass at a temperature between about 700° C. and about 1100° C.

6. The process as claimed in claim 4 wherein the leach solution comprises dilute sulfuric acid and ferric sulfate.

7. The process as claimed in claim 3 additionally comprising lowering a water level control pipe into the borehole, the water level control pipe extending below the ore body for maintaining the water level below the lower portion of said ore body.

8. A process for the recovery of copper values from an ore body which comprises iron-copper sulfide minerals, the process comprising the steps of:

fragmenting an ore body comprising iron-copper sulfide minerals to form a fragmented mass comprising iron-copper sulfide mineral particles;

roasting the fragmented mass comprising iron-copper sulfide mineral particles in situ for concentrating copper values in a center region of such a roasted iron-copper sulfide mineral particle and for forming an iron-rich oxide crust surrounding such a center region;

removing the iron-rich oxide crust to expose the center region of such an iron-copper sulfide mineral particle; and thereafter leaching copper values from such roasted iron-copper sulfide mineral particles.

9. The process as claimed in claim 8 wherein the iron-copper sulfide minerals comprise chalcopyrite.

10. The process as claimed in claim 8 comprising roasting the fragmented mass of iron-copper sulfide mineral particles in situ at a temperature between about 250° C. and about 1500° C.

11. The process as claimed in claim 8 comprising roasting the fragmented mass of iron-copper sulfide mineral particles in situ by igniting at least a portion of the iron-copper sulfide minerals contained in the fragmented mass and by introducing an oxygen-supplying gas into the fragmented mass for maintaining combustion of such iron-copper sulfide minerals for forming a combustion gas comprising sulfur dioxide.

12. The process as claimed in claim 8 comprising leaching copper values from the roasted iron-copper sulfide mineral particles by introducing a mineral acid solution into the fragmented mass of roasted iron-copper sulfide mineral particles.

13. The process as claimed in claim 12 comprising introducing a dilute sulfuric acid solution into the fragmented mass of roasted iron-copper sulfide mineral particles.

14. The process as claimed in claim 13 comprising the additional steps of recovering sulfur dioxide from such a combustion gas and forming sulfuric acid from the recovered sulfur dioxide for forming the dilute sulfuric acid solution.

15. The process as claimed in claim 13 comprising introducing a dilute sulfuric acid solution additionally comprising ferric sulfate into the fragmented mass of roasted iron-copper sulfide mineral particles.

* * * * *